US005565664A

United States Patent [19]

Chen

[11] Patent Number: 5,565,664

[45] Date of Patent: Oct. 15, 1996

[54] VIBRATION TYPE SWITCHES

[76] Inventor: Mei-huey Chen, 4th Fl., No. 29, Lane 58, Sec. 1, Linhsing Rd., Sanchung City, Taipei Hsien, Taiwan

[21] Appl. No.: 502,221

[22] Filed: Jul. 13, 1995

[30] Foreign Application Priority Data

Sep. 8, 1994 [CN] China ..... 94221170.7

[51] Int. Cl.[6] ..... H01H 35/14

[52] U.S. Cl. ..... 200/61.45 R; 200/61.53

[58] Field of Search ..... 200/61.45 R, 61.45 M, 200/61.46, 61.47, 61.48, 61.51, 61.52, 61.53, 61.83

[56] References Cited

U.S. PATENT DOCUMENTS 3,657,499 4/1972 Gawlick et al. ..... 200/61.45 R
3,657,500 4/1972 Gawlick et al. ..... 200/61.45 R
3,742,163 6/1973 Gawlick et al. ..... 200/61.53 X
4,789,762 12/1988 Miller et al. ..... 200/61.45 R
5,134,255 7/1992 Tetault et al. ..... 200/61.53 X

*Primary Examiner*—J. R. Scott
*Attorney, Agent, or Firm*—Bacon & Thomas

[57] ABSTRACT

A vibration type circuit switch includes a base, a first electrical contact coupled to the base; a second electrical contact having a biasing element and being coupled to the base and spaced apart from the first electrical contact. A slider is in electrical contact with the biasing element of the second electrical contact and is biased away from the first electrical contact means. The first and second electrical contacts are respectively soldered to respective ends of a circuit. The slider is movable in relation to the first electrical contact such that the slider can selectively contact the first electrical contact close the circuit when the switch is subject to vibrations.

3 Claims, 2 Drawing Sheets

VIBRATION TYPE SWITCHES

BACKGROUND OF THE INVENTION

1. Field of the Invention

The present invention relates to a circuit switch and, more particularly, to a vibration type circuit switch.

2. Description of Related Art

In addition to bright colors, lights and sounds are main factors of toys that will get children's attention. Although there are various devices provided in toys to cause sounds and lights to make them more attractive to children, they all have one or more shortcomings as listed hereafter. Firstly, a manually operated switch is normally required to turn the lights and/or the sounds on/off. Secondly, a specific device is required to generate the sounds and lights and the structure of the device tends to be complicated. Thirdly, the pattern of the sounds and lights is predetermined, that is, the sounds and lights are not instantaneously and interactively generated with the toys' player.

The present invention provides a vibration type circuit switch such that the sounds and lights of the toys and be activated by shaking the toys and the structure of the switch is very simple and manufacturing cost thereof is low.

SUMMARY OF THE INVENTION

The main object of the present invention is to provide a circuit switch which is operated by shaking to close/open a circuit.

Another object of the present invention is to provide a circuit switch which has a simple structure and a low manufacturing cost.

The above objects are achieved by providing a vibration type circuit switch which includes a base; a first electrical contact means coupled to the base, the first electrical contact means being soldered to one end of a circuit; a second electrical contact means having an elastic biasing element attached thereto, the second electrical contact means being coupled to the base and spaced apart from the first electrical contact means, the second electrical contact means being soldered to another end of the circuit; and a slider being in electrical contact with the biasing element of the second electrical contact means and biased away from the first electrical contact means, the slider being movable in relation to the first electrical contact means such that the slider can selectively contact the first electrical contact means to thereby close the circuit when the switch is subjected to vibrations.

In accordance with one aspect of the present invention, the first electrical contact means includes a plate; an arm having a vertical portion and a horizontal ring portion, the arm being coupled to the plate at a free end of the vertical portion; and a hollow pin tightly coupling the arm to the base by extending a portion thereof through the horizontal ring portion of the arm and into the base.

In accordance with another aspect of the present invention, the second electrical contact means further includes a contact ring; an extension having a vertical portion and a horizontal portion, the extension being coupled to the contact ring at a free end of the vertical portion; and a hollow pin tightly coupling the extension to the base by extending a portion thereof through the horizontal portion of the extension and into the base.

In accordance with a further aspect of the present invention, the elastic biasing element is a helical spring.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
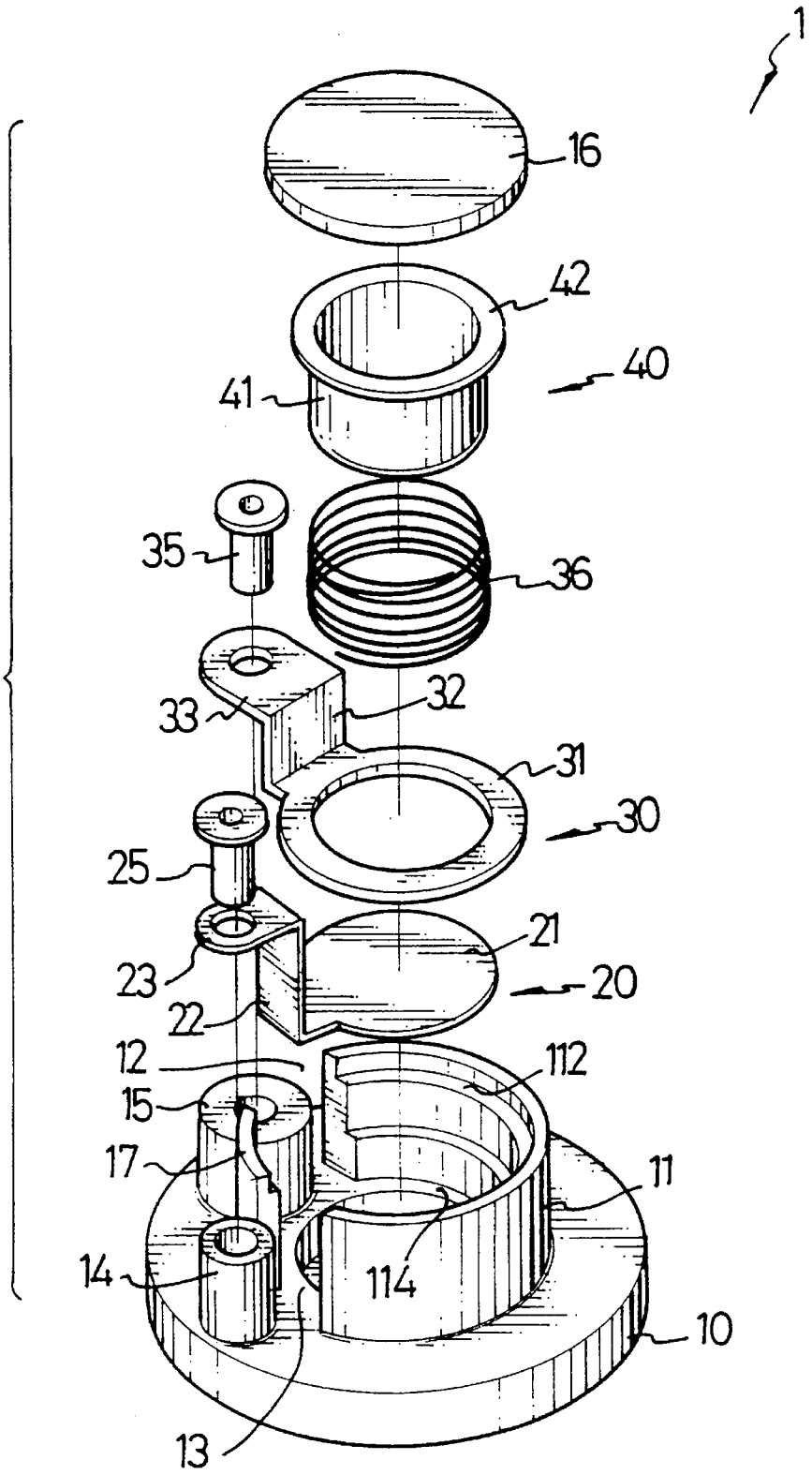
FIG. 1 is an exploded perspective view of a vibration type circuit switch in accordance with the present invention.

Referring to the drawings and initially to FIG. 1, the vibration type circuit switch 1 in accordance with the present invention generally includes a disk shaped base 10 having a cylindrical wall 11 upwardly formed at a central portion thereof and thereby defining an inner cylindrical space, a first electrical contact means 20 coupled to the base 10, a second electrical contact means 30 coupled to the base 10 and spaced from the first electrical contact means 20, a slider 40 movably received within the cylindrical space of the base 10 and an end cap 16.

The wall 11 of the base 10 preferably has two axial openings 12 and 13 spacedly defined therein such that a wall segment 17 is formed between the two openings. Further, the wall 11 has a peripheral recess 112 defined in a free end thereof. The recess 112 has a peripheral step 314 defined therein. The base 10 further comprises a first hollow post 14 upwardly formed at a position proximate to the opening 13 of the wall 11 and a second hollow post 15 upwardly formed at a position proximate the opening 12. Preferably, the base 10, the cylindrical wall 11, the first and second hollow post 14, 15 are made of elastic and electrically insulating materials and the slider 40 is made of magnetic steel.

The first electrical contact means 20, preferably, has a circular plate 21 disposed on an upper surface of the base 10, an inverted L-shaped arm 22 extending upward from the plate 21 with a vertical portion thereof connected to the plate 21 and a horizontal ring 23 thereof laid on a free end of the first hollow cylindrical post 14, and a first hollow pin 25 downwardly extending through the ring 23 into the first hollow cylindrical post 14 thereby fastening the first electrical contact means 20 to the base 10.

The second electrical contact means 30, preferably, includes a contact ring 31, an inverted L-shaped extension 32 extending upward from the contact ring 31 with a vertical portion thereof integrally formed with the contact ring 31 and a horizontal portion 33 thereof rested on a free end of the second hollow cylindrical post 15, a bias spring 36 placed on the contact ring 31, and a second hollow pin 35 downwardly extending through the horizontal portion 33 of the extension 32 into the second hollow cylindrical post 15 thereby indirectly fastening the contact ring 31 to the base 10. The first and second electrical contact means 20, 30 are constructed such that the contact ring 31 is located a distance above the circular plate 21.

The slider 40 has a cylindrical body 41 and a flange 42 formed at a periphery of a first end of the body 41 of the slider 40. The slider 40 is movably received in the inner space defined by the wall 11 with the body portion 41 thereof extending through the spring 26 and the contact ring 31 and the flange 42 thereof abutting the spring 26. The end cap 16 is placed on top of the slider 40 and rested on the recess 112 of the wall 11.

Figure 2:
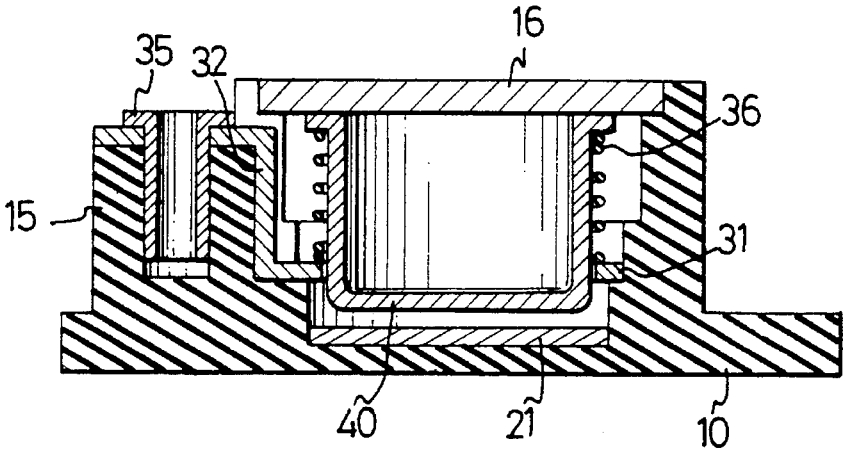
FIG. 2 is a vertical cross-sectional view of an assembled vibration type circuit switch according to the present invention showing an "off" state of the switch.
Figure 4:
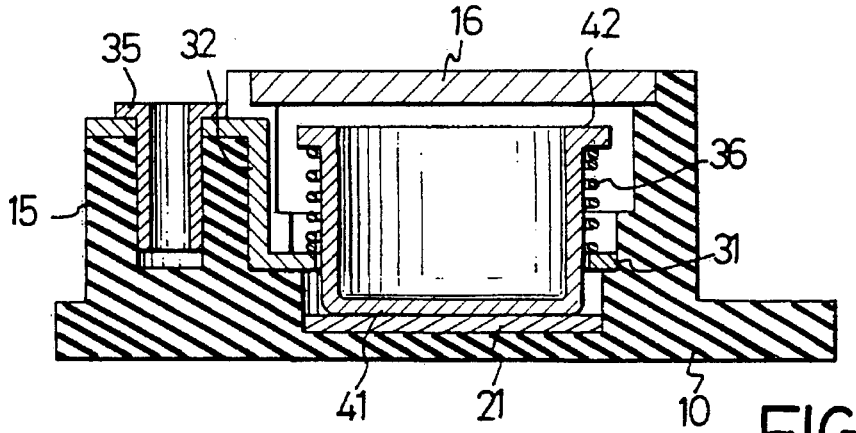
FIG. 4 is a schematic illustration of a circuit diagram in which a vibration type switch in accordance with the present invention is utilized.
Figure 3:
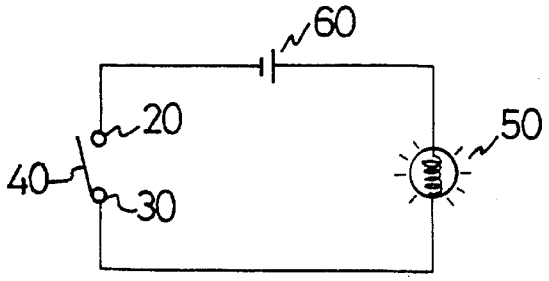
FIG. 3 is a vertical cross-sectional view of an assembled vibration type circuit switch according to the present invention showing an "on" state of the switch.

Referring now to FIGS. 2, 3, and 4, the switch 1 in accordance with the present invention can be utilized in a simple circuit having a power source 60 and a light-emitting diode (LED), as shown in FIG. 4. In this case, one end of the circuit is soldered to the first hollow pin 25 of the first electrical contact means 20 and the other end of the circuit is soldered to the second hollow pin 35 of the second electrical contact means 30. Turning now to FIGS. 2 and 3, when the switch 1 is in a steady state or subjected to a mild vibration, the body portion 41 of the slider 40 will remain disconnected with the circular plate 21 and thus the circuit remains open, as shown in FIG. 2. When the switch 1 is subjected a vibration which is violent enough to cause the slider 40 to overcome the upward biasing force provided by the spring 36, the slider 40 is then moved downward to contact the circular plate 21 and thus the circuit is closed and the LED is lit, as shown in FIG. 3.

Although the invention has been explained in relation to its preferred embodiment, it is to be understood that many other possible modifications and variations can be made without departing from the spirit and scope of the invention as hereinafter claimed.

I claim:

1. A vibration type circuit switch comprising:

a base;

a first electrical contact means coupled to the base, the first electrical contact means being soldered to one end of a circuit;

a second electrical contact means having an elastic biasing element attached thereto, the second electrical contact means being coupled to the base and spaced apart from the first electrical contact means, the second electrical contact means being soldered to another end of the circuit and comprising:

a contact ring;

an extension having a vertical portion and a horizontal portion, the extension being coupled to the contact ring at a free end of the vertical portion; and a hollow pin tightly coupling the tension to the base by extending a portion thereof through the horizontal portion of the extension and into the base; and a slider being in electrical contact with the biasing element of the second electrical contact means and biased away from the first electrical contact means, the slider being movable in relation to the first electrical contact means such that the slider can selectively contact the first electrical contact means to thereby close the circuit when the switch is subjected to vibrations.

2. The switch as claimed in claim 1 wherein the first electrical contact means comprises:

a plate;

an arm having a vertical portion and a horizontal ring portion, the arm being coupled to the plate at a free end of the vertical portion; and a hollow pin tightly coupling the arm to the base by extending a portion thereof through the horizontal ring portion of the arm and into the base.

3. The switch as claimed in claim 1 wherein the elastic biasing element is a helical spring.

* * * * *